US009711028B1

(12) United States Patent
Friedman

(10) Patent No.: US 9,711,028 B1
(45) Date of Patent: Jul. 18, 2017

(54) ELECTRICAL WARNING SYSTEM FOR A STEP LADDER

(71) Applicant: Benjamin Friedman, St. Johns, FL (US)

(72) Inventor: Benjamin Friedman, St. Johns, FL (US)

( * ) Notice: Subject to any disclaimer, the term of this patent is extended or adjusted under 35 U.S.C. 154(b) by 0 days.

(21) Appl. No.: 14/793,090

(22) Filed: Jul. 7, 2015

(51) Int. Cl.
*G08B 21/04* (2006.01)

(52) U.S. Cl.
CPC ..... *G08B 21/0461* (2013.01)

(58) Field of Classification Search
CPC ..... E06C 7/003; E06C 5/44; G08B 21/0461; G08B 21/0469
USPC ..... 182/18, 129; 340/573.1, 541, 666, 686.1
See application file for complete search history.

(56) References Cited

U.S. PATENT DOCUMENTS

| | | | | |
|---|---|---|---|---|
| 3,298,012 | A | 1/1967 | Weller | |
| 4,311,208 | A | 1/1982 | Macrorie et al. | |
| 4,320,380 | A * | 3/1982 | Berard | E01F 13/06 340/935 |
| 5,954,154 | A | 9/1999 | Ziolkowski | |
| 5,971,102 | A | 10/1999 | Brown | |
| 6,578,663 | B2 | 6/2003 | Schmitt et al. | |
| 2005/0173189 | A1 | 8/2005 | Berardi | |
| 2009/0139798 | A1* | 6/2009 | Bernard | E06C 7/003 182/18 |
| 2010/0018800 | A1 | 1/2010 | Ventura et al. | |
| 2011/0148645 | A1 | 6/2011 | Sarmiento | |
| 2013/0113617 | A1* | 5/2013 | Wang | E06C 7/003 340/521 |
| 2013/0140111 | A1 | 6/2013 | Desai | |
| 2016/0110981 | A1* | 4/2016 | Chin | A01M 29/00 340/573.1 |

OTHER PUBLICATIONS

Modern Dictionary of Electronics, 7th Ed., Rudolph F. Graf, 1999, Butterworth-Heinemann, ISBN 0-7506-9866-7, p. 481.*

* cited by examiner

*Primary Examiner* — Quan-Zhen Wang
*Assistant Examiner* — Stephen Burgdorf
(74) *Attorney, Agent, or Firm* — Glenn E. Gold; Glenn E. Gold, P.A.

(57) ABSTRACT

A warning circuit for use on ladders includes a first sensor responsive to the placement of a first of a user's feet thereon and a second sensor responsive to the placement of a second of the user's feet thereon. The second sensor is electrically connected in series to the first sensor, and a relay is electrically connected in series to one of the first and second sensors. A power source has a power output terminal electrically connected in series to the other of the sensors connected in series. A sound device is electrically connected to a load output of the relay and to the power source. The load output of the relay is energized only when the first sensor is activated prior to activation of the second sensor whereupon the load output then energizes the sound device.

16 Claims, 6 Drawing Sheets

ELECTRICAL WARNING SYSTEM FOR A STEP LADDER

FIELD OF THE INVENTION

The present disclosure generally relates to apparatuses and methods for ladder safety. More particularly, the present disclosure relates to a warning apparatus on a ladder for warning a climber when climbing to the top steps or descending to the bottom steps of the ladder.

BACKGROUND OF THE INVENTION

Ladders have become a useful tool to almost every individual in society and permit individuals to climb to heights unreachable by the unaided. Individual ladders can range from small stepladders having 2-3 rungs allowing an individual to access that one item just out of reach to large extension ladders that can extend to 40 feet and more for scaling large walls, trees, and buildings. One or more ladders can be found in almost every household and are utilized by professional tradesmen of all types.

Unfortunately, the design and usage of a ladder also contributes to its inherent instability and danger. A ladder is typically constructed of two spaced apart vertical stiles with a plurality of regularly spaced rungs extending between the stiles. The bottom end of each stile also functions as the support foot for the ladder at its base. While the base of some ladders may be wider than the ladder top, the overall width of the ladder is relatively narrow when compared to its height. As the width to height ratio decreases (with increasing ladder height) the lateral stability of the ladder also decreases such that a minor lateral shift in the combined center of gravity of the ladder, including the user who is climbing the ladder, can result in an unwanted lateral shift of the ladder. As the user climbs the ladder the combined center of gravity also translates up the ladder, and consequently the danger from a minor lateral shift in the center of gravity increases proportionately as the center of gravity rises. In extreme cases, the unwanted lateral shift can and often does result in the ladder falling to the ground with the user suffering serious injuries as a result thereof. The U.S. Consumer Product Safety Commission (CPSC) reports that each year there are in excess of 150,000 emergency room-treated injuries in the U.S. relating to ladders. A significant portion of which are attributable to ladder falls.

These instabilities require the total concentration of the individual climbing or descending the ladder. Probably the greatest danger to a climber is when he is approaching the topmost or bottommost rungs. He is often unable to look down to determine on which rung he is standing. Consequently, while ascending, he may think he has more rungs on which he can step at the top of the ladder thereby resulting in the ladder tipping or losing a stable foothold resulting in the ladder tipping while at a significant height. Also, when descending, he may believe he is on the bottom rung and prepare his next step for dismounting from the ladder. If however, he has misjudged the rung, he may end up attempting to dismount from a rung higher on the ladder and then fall the remainder of the way to the ground.

The inability to determine the exact rung on which he is standing at the top while climbing or at the bottom when descending will very likely result in injury to the climber unless he is able to determine when he has reached a specific top or bottom rung. Therefore, there is a need for a warning system on the ladder to automatically indicate to the climber when he has reached the top or the bottom to prevent injury to the climber.

SUMMARY OF THE INVENTION

The present disclosure is generally directed to an electronic warning circuit for installation on a ladder of the type having a plurality of spaced apart rungs for warning a user of approaching an end of the ladder in a single direction. The warning circuit includes a first sensor responsive to the placement of a first of a user's feet thereon and a second sensor responsive to the placement of a second of the user's feet thereon. The second sensor is electrically connected in series to the first sensor. A relay is electrically connected in series to one of the first and second sensors, and a power source has a power output terminal electrically connected in series to the other of the sensors connected in series. A sound device is electrically connected to a load output of the relay and to the power source. The load output of the relay is energized only when the first sensor is activated prior to activation of the second sensor whereupon the load output then energizes the sound device.

In another aspect, the relay is a single shot latching relay.

In still another aspect, the load output, when energized, is energized for a predetermined period of time and is then de-energized.

In yet another aspect, the first sensor is a normally open push-to-make switch and the second sensor is a normally open momentary push-to-make switch.

In a still further aspect, the single shot latching relay includes a start switch terminal, a common terminal, a power input terminal, and a load output terminal. The start switch terminal is electrically connected to one of these sensors such that the power terminal of the power source, the first sensor, the second sensor, and the start switch terminal are electrically connected in series. The common terminal is electrically connected to a common terminal of the power source and the power input terminal is electrically connected to the power terminal of the power source. The load output terminal is electrically connected to the sound device, and the sound device is further connected to the common terminal of the power source.

In another aspect, the power source is a battery, wherein the power output terminal of the power source is a positive terminal of the battery and the common terminal of the power source is a negative terminal of the battery.

In another aspect, the sound device is a piezo sound generator.

In a still further aspect, a safety ladder incorporating a warning circuit indicating when a user approaches an end of the safety ladder includes a ladder having two stiles laterally spaced one from the other and a plurality of rungs substantially regularly spaced therealong. The rungs are affixed to and laterally extend between the stiles. An electronic warning circuit sensing a user approaching an end of the ladder and issuing an audible warning in response thereto includes a first sensor affixed to a first of two adjacent rungs and is responsive to the placement of a first of a user's feet thereon. A second sensor is affixed to a second of the two adjacent rungs and is responsive to the placement of a second of the user's feet thereon, wherein the second sensor is electrically connected in series to the first sensor. A relay is electrically connected in series to one of the first and the second sensors. A power source has a power output terminal electrically connected in series to the other of the sensors in series therewith, and a sound device is electrically connected to a load output of the relay and to the power source. The load output of the relay is energized only when the first sensor is activated prior to activation of the second sensor, the load output then energizes the sound device.

In yet another aspect, the relay is a single shot latching relay.

In another aspect, the load output, when energized, is energized for a predetermined period of time and is then de-energized.

In still another aspect, the first sensor is a normally open push-to-make switch and the second sensor is a normally open momentary push-to-make switch.

In yet another aspect, the single shot latching relay includes a start switch terminal, a common terminal, a power input terminal, and a load output terminal. The start switch terminal is electrically connected to one of the sensors such that the power terminal of the power source, the first sensor, the second sensor, and the start switch terminal are electrically connected in series. The common terminal is electrically connected to a common terminal of the power source and the power input terminal is electrically connected to the power terminal of the power source. The load output terminal is electrically connected to the sound device and the sound device is further connected to the common terminal of the power source.

In another aspect, the power source is a battery, wherein the power terminal is a positive terminal of the battery and the common terminal is a negative terminal of the battery.

In still another aspect, the sound device is a piezo sound generator.

In yet another aspect, the two adjacent rungs are proximate to a top of the ladder wherein the first rung is a lower one of the two adjacent rungs and the second rung is an upper one of the two adjacent rungs.

In a still further aspect, the two adjacent rungs are a lowermost two rungs of the ladder wherein the first rung is an upper one of the two adjacent rungs and the second rung is a lowermost rung of the two adjacent rungs.

In another aspect, a safety ladder incorporating a warning circuit indicating when a user approaches a top or a bottom of the safety ladder comprises a ladder having two stiles laterally spaced one from the other and a plurality of rungs substantially regularly spaced therealong. The rungs are affixed to and laterally extending between the stiles. An upper electronic warning circuit is incorporated with two adjacent rungs proximate to a top of the ladder and senses a user ascending the ladder. The upper electronic warning circuit issues an audible warning in response thereto wherein the upper electronic warning circuit includes a first sensor affixed to a lower one of the two upper adjacent rungs and is responsive to the placement of a first of a user's feet thereon. A second sensor is affixed to an upper one of the two upper adjacent rungs and is responsive to the placement of a second of the user's feet thereon wherein the second sensor is electrically connected in series to the first sensor. A single shot latching relay is electrically connected in series to one of the first or the second sensors, and a power source having a power output terminal that is electrically connected in series to the other of the sensors in series. A sound device is electrically connected to a load output of the single shot latching relay and to the power source. The load output of the relay is energized only when the first sensor is activated prior to activation of the second sensor, the load output then energizes the sound device. A lower electronic warning circuit is incorporated with two adjacent lowermost rungs of the ladder and senses the user descending the ladder. The lower electronic warning circuit issues an audible warning in response thereto wherein the lower electronic warning circuit includes a first sensor affixed to an upper one of the two lowermost adjacent rungs and is responsive to the placement of a first of a user's feet thereon. A second sensor is affixed to a lower one of the two lowermost adjacent rungs and is responsive to the placement of a second of the user's feet thereon wherein the second sensor is electrically connected in series to the first sensor. A single shot latching relay is electrically connected in series to one of the first and second sensors. A power source has a power output terminal electrically connected in series to the other of the sensors in series. A sound device is electrically connected to a load output of the single shot latching relay and to the power source. The load output of the relay is energized only when the first sensor is activated prior to activation of the second sensor wherein the load output then energizes the sound device.

In another aspect, the first sensor is a normally open push-to-make switch and the second sensor is a normally open momentary push-to-make switch.

In a still further aspect, the single shot latching relay includes a start switch terminal, a common terminal, a power input terminal, and a load output terminal. The start switch terminal is electrically connected to one of the sensors such that the power terminal of the power source, the first sensor, the second sensor, and the start switch terminal are electrically connected in series. The common terminal is electrically connected to a common terminal of the power source and the power input terminal is electrically connected to the power terminal of the power source. The load output terminal is electrically connected to the sound device and the sound device is further connected to the common terminal of the power source.

In yet another aspect, the upper electronic warning circuit and the lower electronic warning circuit are powered by a single battery.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
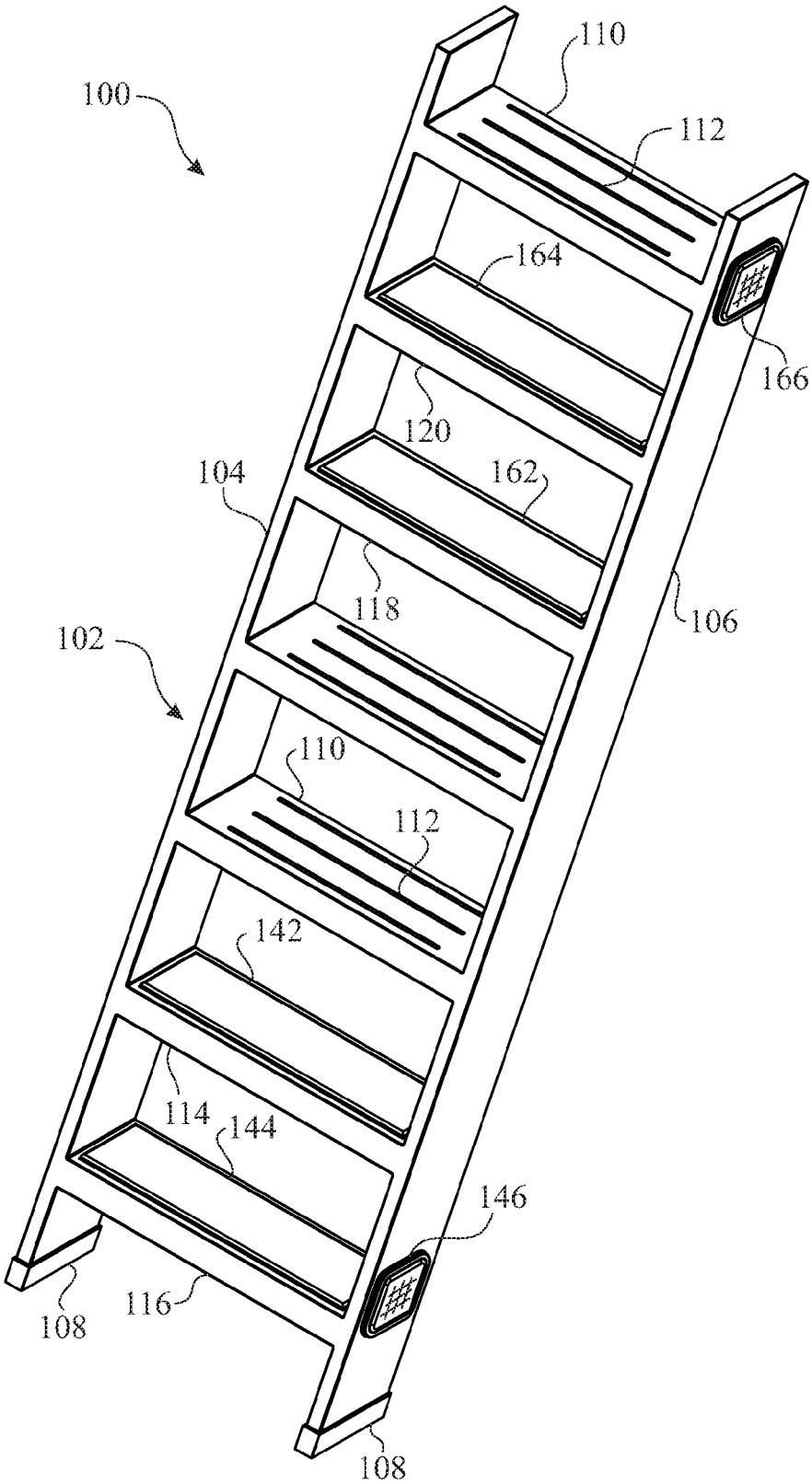
FIG. 1 presents a right front perspective view of a ladder embodying the present invention, wherein top and bottom rungs incorporate sensors to activate an alarm.
Figure 2:
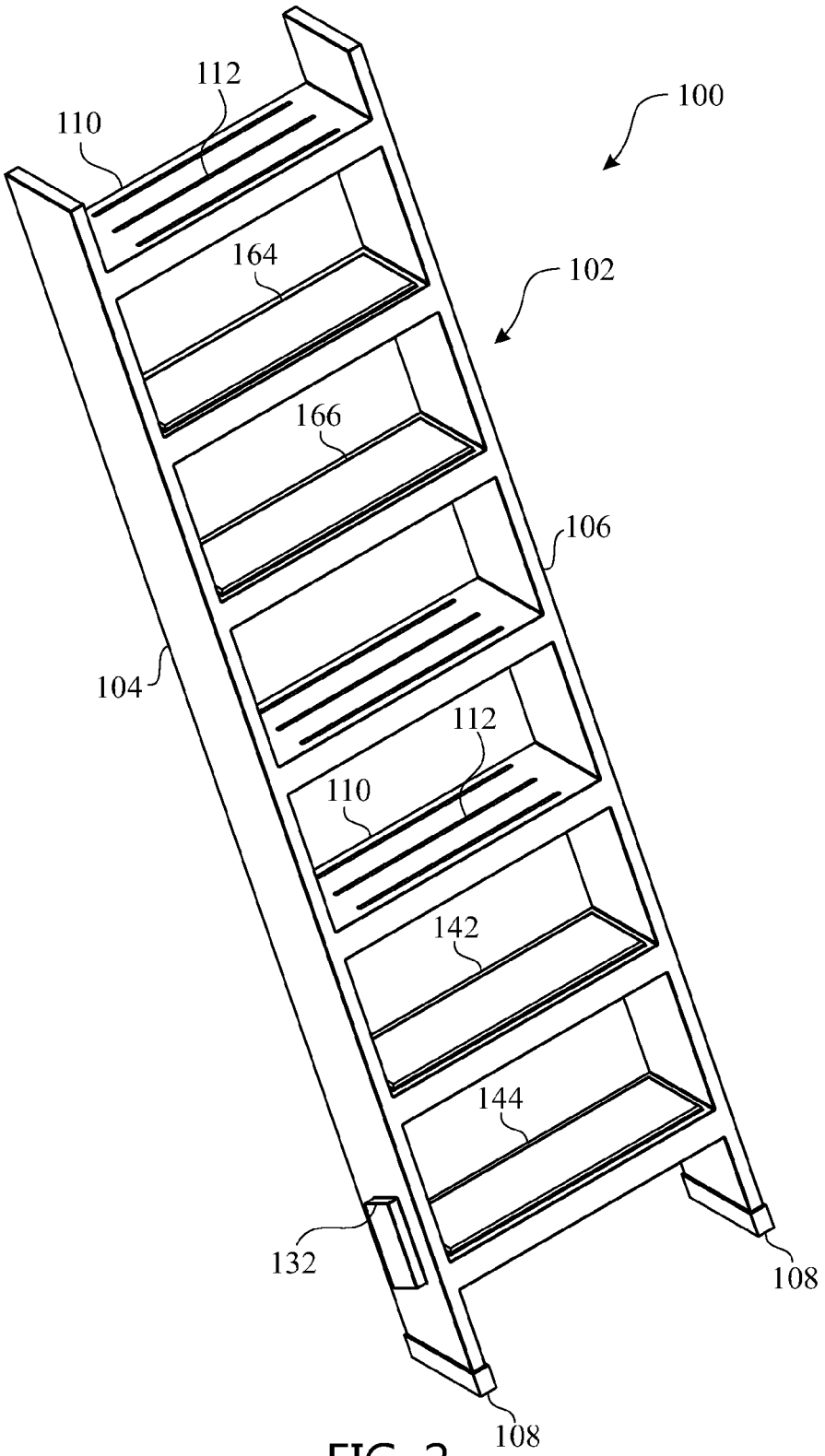
FIG. 2 presents a left front perspective view of the ladder of FIG. 1.
Figure 3:
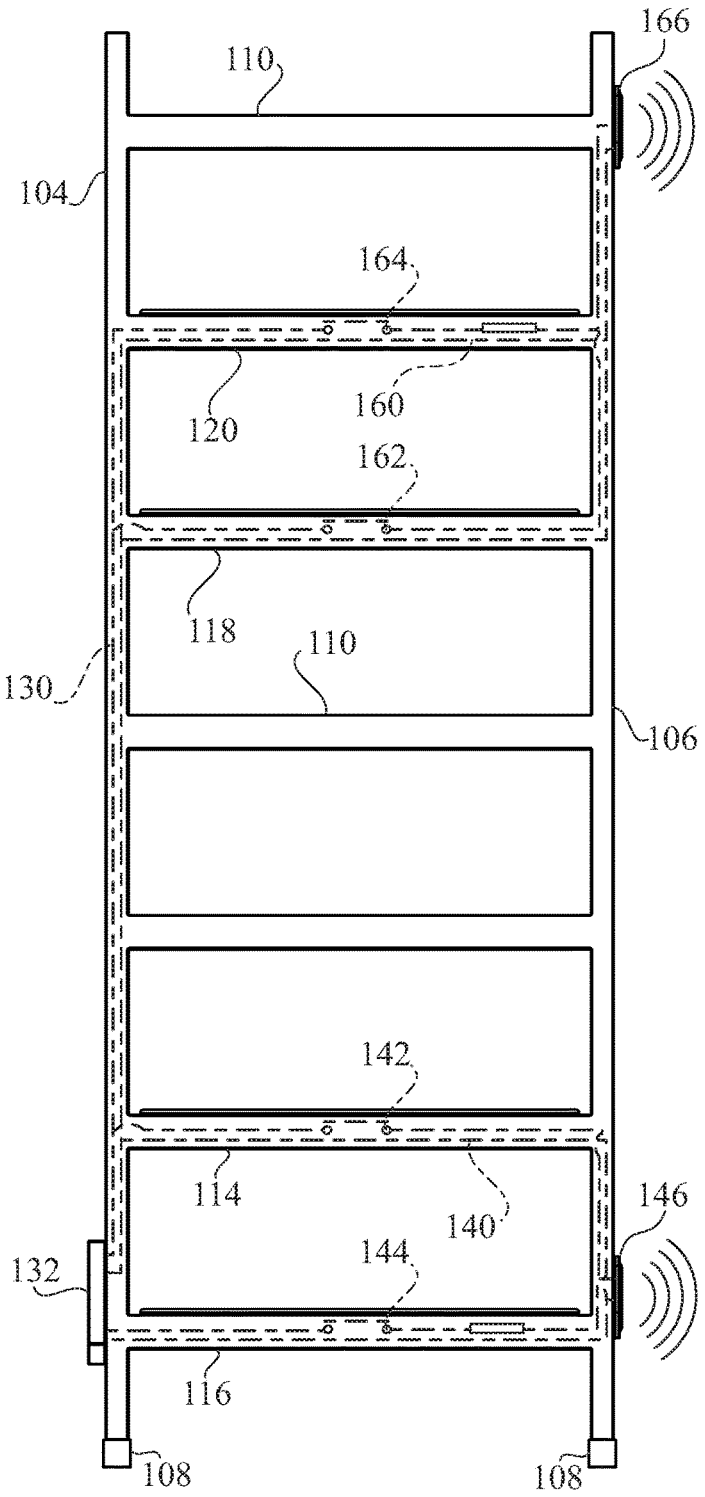
FIG. 3 presents a front elevation view of the ladder.

In one exemplary implementation of the invention, a safety ladder 100 is shown in FIGS. 1-3 illustrating its various components where a ladder 102 is generally comprised of a left vertical stile 104 and a right vertical stile 106 laterally separated one from the other with a plurality of substantially regularly placed rungs 110 affixed to stiles 104 and 106 and extending therebetween. The rungs 110 can also include treads 112 thereon to prevent a user from slipping. A foot 108 at the bottom of each stile 104, 106 can help to stabilize the ladder 102. The safety ladder 100 includes a single warning circuit 140 or a dual warning circuit 130 which substantially combines a lower warning circuit 140 with an upper warning circuit 160 (FIG. 5) to provide a user with an audible warning that the user has reached either the top or the bottom of the ladder.

Referring now to FIGS. 1-3, and 5-6, the dual warning circuit 130 is powered by a battery 132 having a power output terminal 134 (positive terminal) and a common terminal 136 (negative terminal). The lower warning circuit 140 functions to warn a user when he has reached a lower pair of rungs 114, 116 of the safety ladder 100 when descending therefrom. A first sensor 142 is affixed to a first lower rung 114 (as shown the rung 114 is the second rung from the bottom) and as configured the first sensor 142 is a normally open push-to-make switch. A second sensor 144 is affixed to a second lower rung 116 below first lower rung 114, and as configured the second sensor 144 is a normally open momentary push-to-make switch. The first sensor 142 and the second sensor 144 are electrically connected one to the other in series. The first sensor 142 is also connected to the positive terminal 134 of the battery 132. The second sensor 144 is further connected to a start switch terminal 152 of a relay 150 here configured as a single shot latching relay. The relay 150 also includes a common terminal 154 which is connected to the negative terminal 136 of the battery 132. A power input terminal 156 is connected to the positive terminal 134 of the battery 132. The relay 150 further includes a load output terminal 158 which is connected to a sound device 146 such as a piezo sound generator. The sound device 146 is also connected to the negative terminal 136 of the battery 132 to complete the circuit. While the lower pair of rungs 114, 116 is illustrated as the bottommost two rungs a different pair of lower rungs may be chosen for incorporation of the lower warning circuit 140.

The upper warning circuit 160 functions to warn a user when he has reached an upper pair of rungs 118, 120 of the safety ladder 102. A first sensor 162 is affixed to a first upper rung 118 and as configured the first sensor 162 is a normally open push-to-make switch. A second sensor 164 is affixed to a second upper rung 120 above first upper rung 118, and as configured the second sensor 164 is a normally open momentary push-to-make switch. The first sensor 162 and the second sensor 164 are electrically connected one to the other in series. The first sensor 162 is also connected to the positive terminal 134 of the battery 132. The second sensor 164 is also connected to a start switch terminal 152 of a relay 150 here configured as a single shot latching relay. The relay 150 also includes a common terminal 154 which is connected to the negative terminal 136 of the battery 132. A power input terminal 156 is connected to the positive terminal 134 of the battery 132. The relay 150 further includes a load output terminal 158 which is connected to a sound device 166 such as a piezo sound generator. The sound device 166 is also connected to the negative terminal 136 of the battery 132 to complete the circuit. The upper pair of rungs 118, 120 is typically not the uppermost pair of rungs 110, but the rung pair is typically represent the uppermost rungs to which a user may safely climb.

Figure 6:
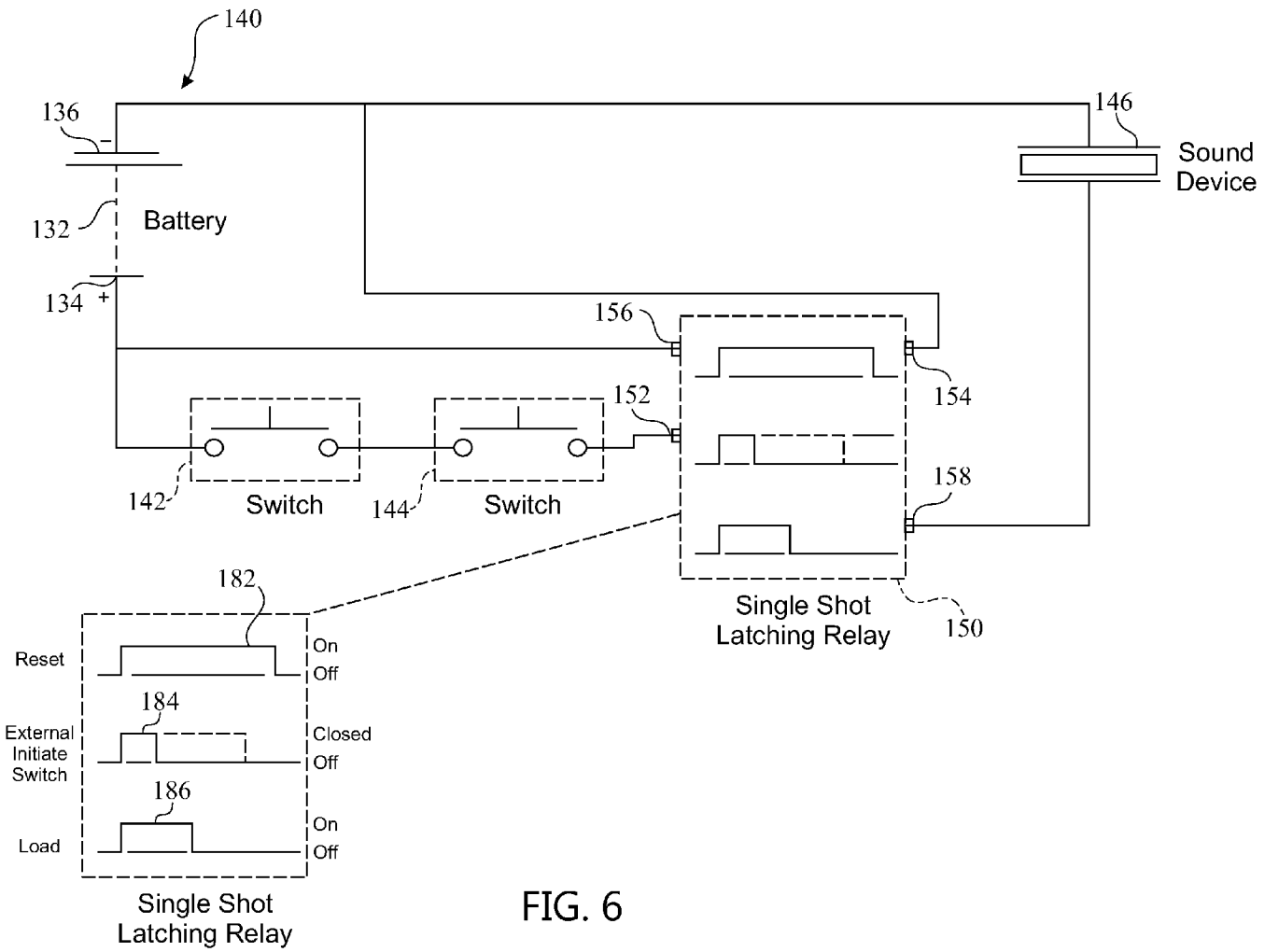
FIG. 6 presents a circuit diagram for a single alarm circuit for use on a ladder.

The functionality of the single shot latching relay 150 is illustrated in FIG. 6 wherein step curve 182 illustrates the power input over time to the power input terminal 156 of the relay 150. The step curve 184 illustrates the momentary power pulse to activate the load output of the relay 150, and the step curve 186 illustrates the timed power output to the sound devices 146, 166.

Figure 4:
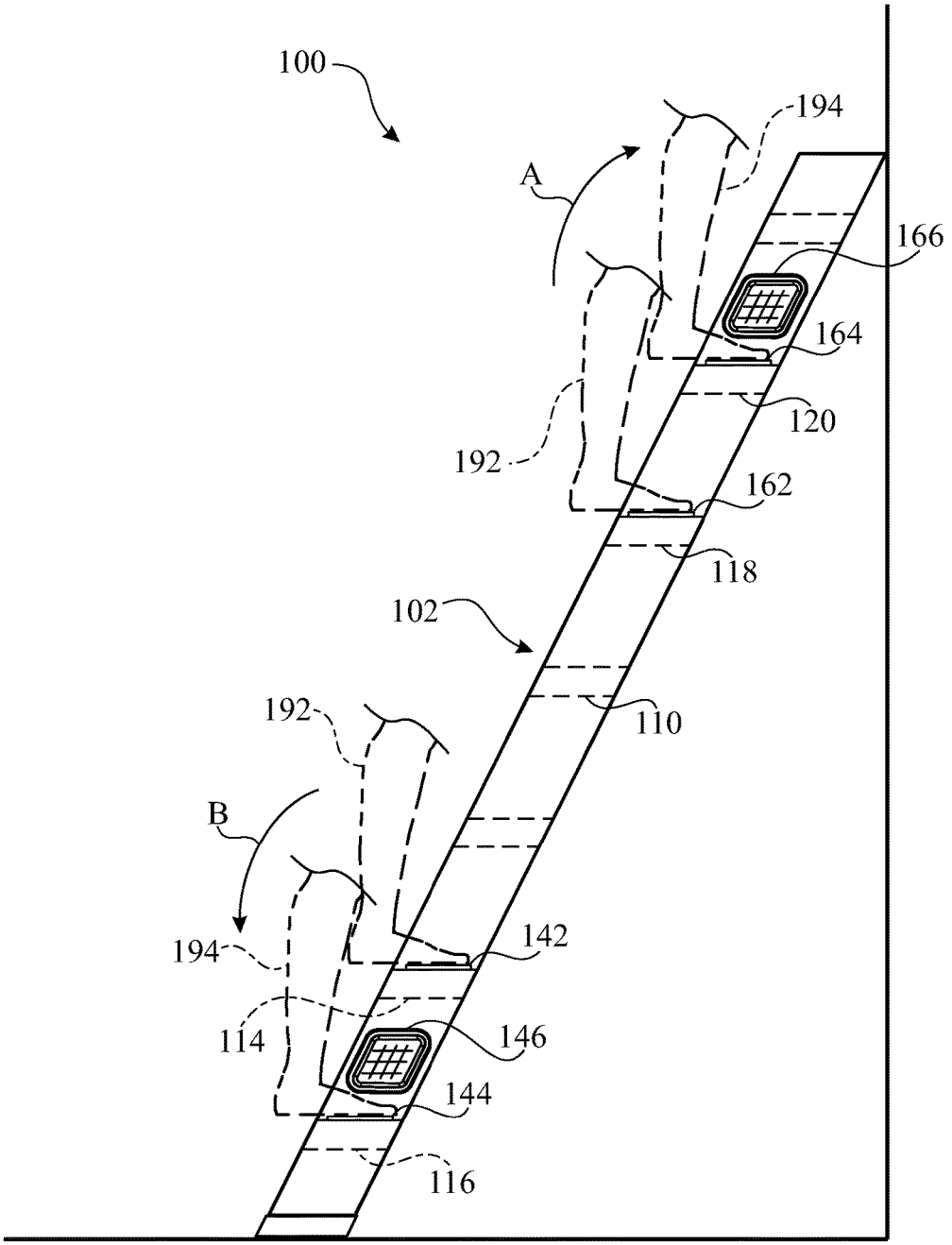
FIG. 4 presents a right side elevation view illustrating a user descending at the bottom rungs and a user ascending at the top rungs.
Figure 5:
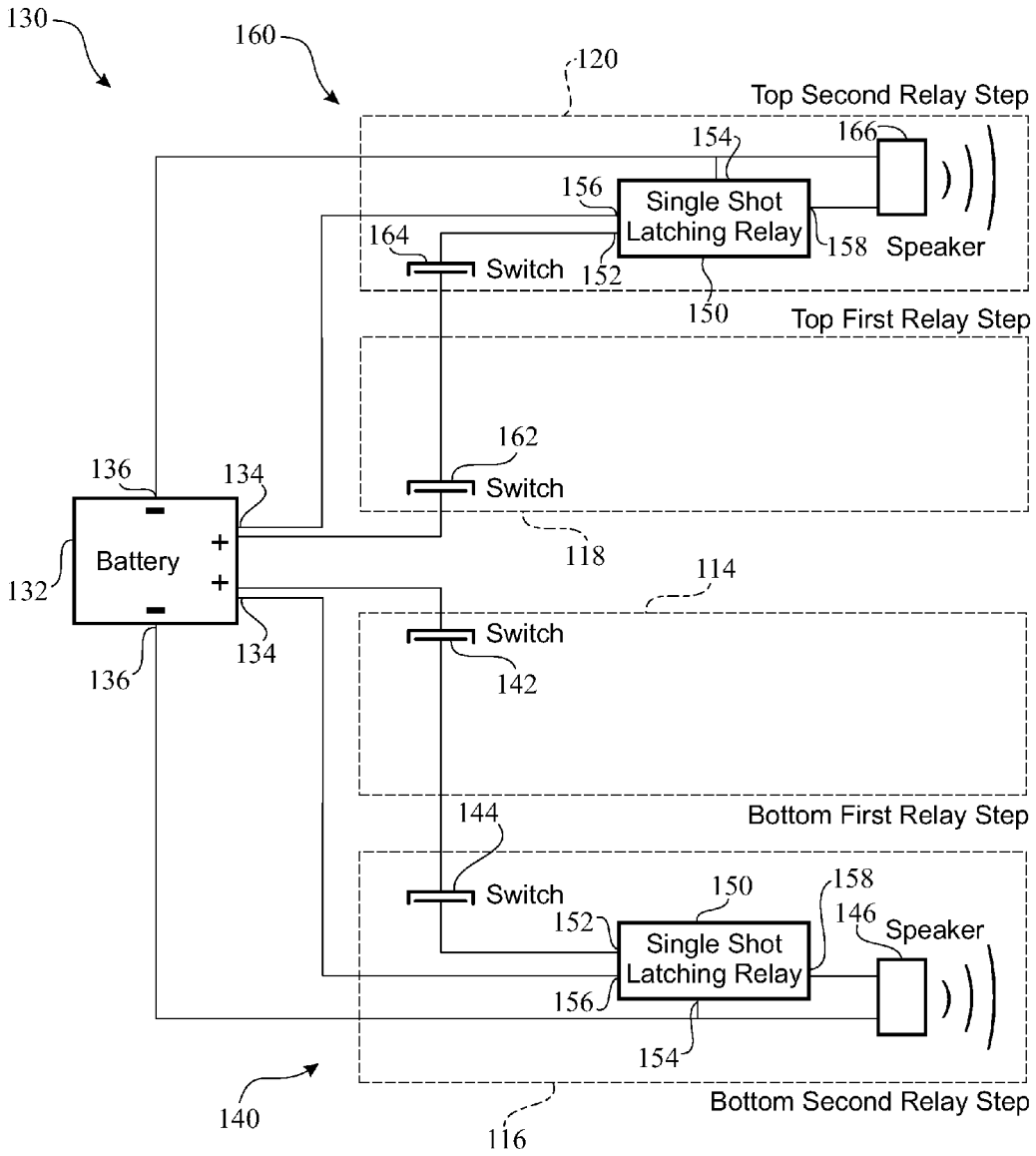
FIG. 5 presents a circuit diagram of a representative ladder incorporating alarms at a top and bottom of the ladder.

In use, as illustrated in FIG. 4 and also in reference to FIG. 5, a user climbs the safety ladder 102. When approaching a top of the safety ladder 100, the user's first, foot 192 steps on the first upper rung 118 which closes the normally open switch 162. As the user continues to climb his weight is supported by the first foot 192 while his second foot 194 is raised to the second upper rung 120. As he begins to shift his weight from his first foot 192 to his second foot 194, the normally open momentary switch 164 closes and the normally open switch 162 remains closed. The normally open momentary switch 164 only closes momentarily and then resets to an open state even though the user's second foot 194 continues to put pressure on the switch 164. The momentary closing of the normally open momentary switch 164 is sufficient to complete the current path from the positive terminal 134 of the battery 132 to the start switch terminal 152 of the relay 150 thereby generating the step curve 184 to activate the load output of the relay 150. The single shot latching relay 150 then generates the load output represented by the step curve 186 at load output terminal 158 which continues for a predetermined time duration that is longer than the time duration of the momentary triggering pulse 184. The output load 186 drives the sound device 166 to provide an audible warning for the time duration of the output load represented by the step curve 186 thereby indicating that the user has reached the uppermost safety limit of the safety ladder 100.

Similarly, when the user has completed his task at the top of the safety ladder 100 he begins to descend. When approaching a bottom of the safety ladder 100, the user's first foot 192 steps on the first lower rung 114 which closes the normally open switch 142. As the user continues to descend, his weight is supported by the first foot 192 while his second foot 194 is lowered to the second lower rung 116.

As he begins to shift his weight from his first foot 192 to his second foot 194, the normally open momentary switch 144 closes and the normally open switch 142 remains closed. The normally open momentary switch 144 only closes momentarily and then resets to an open state even though the user's second foot 194 continues to put pressure on the switch 144. The momentary closing of the normally open momentary switch 144 is sufficient to complete the current path from the positive terminal 134 of the battery 132 to the start switch terminal 152 of the relay 150 thereby generating the step curve 184 to activate the load output of the relay 150. The single shot latching relay 150 then generates the load output represented by the step curve 186 at the load output terminal 158 which continues for a predetermined time duration that is longer than the time duration of the momentary triggering pulse 184. The output load 186 drives the sound device 146 to provide an audible warning for the time duration of the load output represented by the step curve 186 thereby indicating that the user has reached the bottom of the safety ladder 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed:

1. An electronic warning circuit for installation on a ladder of the type having a plurality of spaced apart rungs for warning a user of approaching an end of the ladder in a single direction, said electronic warning circuit comprising:

a first sensor comprising an electrical switch, affixed to a first one of a pair of rungs of a ladder proximate an end thereof, responding to placement of a first of a user's feet on said first sensor by changing said first sensor from a non-conducting state to a conducting state, for an entire time the first of the user's feet is placed on the first sensor;

a second sensor comprising an electrical switch electrically connected in series with said first sensor, affixed to a second adjacent one of the pair of rungs of the ladder proximate the end thereof, responding to placement of a second of the user's feet on said second sensor by changing said second sensor from a non-conducting state to a conducting state beginning from the time of initial placement of the second of the user's feet on said second sensor, for a predetermined period of time, and returning to the non-conducting state after the predetermined period of time has elapsed, said predetermined period of time being less than the time the user takes to move his feet from one rung to the next rung;

a latching relay having a start terminal electrically connected to said second sensor, said latching relay also having a power input terminal a common terminal and a load output terminal;

a power source having a power output terminal electrically connected to said first sensor and said power input terminal of said latching relay, said power source also having a common terminal; and a sound device electrically connected to said load output terminal of said latching relay and to said common terminal of said power source to complete said electronic warning circuit;

wherein said load output terminal of said latching relay, and thereby said sound device, are energized when both said first and second sensors are in conducting states at the same time in response to placement of the first and second feet of said user on said first and second sensors as the user moves in the direction of the first rung to the second rung.

2. The electronic warning circuit according to claim 1 wherein said latching relay is a single shot latching relay.

3. The electronic warning circuit according to claim 2 wherein said load output terminal of said latching relay, when energized, is energized for a predetermined period of time and is then de-energized.

4. The electronic warning circuit according to claim 1 wherein said power source is a battery, said power output terminal being a positive terminal of said battery, and said common terminal being a negative terminal of said battery.

5. The electronic warning circuit according to claim 1 wherein said alarm sound device is a piezo sound generator.

6. A safety ladder incorporating a warning circuit indicating when a user approaches an end of said safety ladder, said safety ladder comprising:

a ladder having two stiles laterally spaced one from the other and a plurality of rungs substantially regularly spaced therealong, said rungs affixed to and laterally extending between said stiles; and an electronic warning circuit sensing a user approaching an end of said ladder in a single direction and issuing an audible warning in response thereto, said electronic warning circuit comprising:

a first sensor affixed to a first of two adjacent rungs proximate said end of said ladder and responsive to the placement of a first of a user's feet on said first sensor by changing said first sensor from a non-conducting state to a conducting state, for an entire time the first of the user's feet is placed on the first sensor;

a second sensor affixed to a second of said two adjacent rungs proximate said end of said ladder and responsive to the placement of a second of the user's feet on said second sensor by changing said second sensor from a non-conducting state to a conducting state beginning from the time of initial placement of the second of the user's feet on said second sensor, for a predetermined period of time, and returning to the non-conducting state after the predetermined period of time has elapsed, said predetermined period of time being less than the time the user takes to move his feet from one rung to the next rung, said second sensor being electrically connected in series to said first sensor;

a latching relay having a start terminal electrically connected to said second sensor, said latching relay also having a power input terminal, a common terminal, and a load output terminal;

a power source having a power output terminal electrically connected to said first sensor and said power input terminal of said latching relay, said power source also having a common terminal; and a sound device electrically connected to said load output terminal of said latching relay and to said common terminal of said power source to complete said electronic warning circuit;

wherein said load output terminal of said latching relay and thereby said sound device, are energized when both said first and second sensors are in conducting states at the same time in response to placement of the first and second feet of the user on said first and second sensors as the user moves in the direction of the first rung to the second rung.

7. The safety ladder according to claim 6 wherein said latching relay is a single shot latching relay.

8. The safety ladder according to claim 7 wherein said load output terminal of said latching relay, when energized, is energized for a predetermined period of time and is then de-energized.

9. The safety ladder according to claim 7 wherein said first and second sensors are switches.

10. The safety ladder according to claim 6 wherein said power source is a battery, said power output terminal being a positive terminal of said battery, and said common terminal being a negative terminal of said battery.

11. The safety ladder according to claim 6 wherein said sound device is a piezo sound generator.

12. The safety ladder according to claim 6 wherein said two adjacent rungs are proximate to a top of said ladder and wherein said first rung is a lower one of said two adjacent rungs and said second rung is an upper one of said two adjacent rungs.

13. The safety ladder according to claim 6 wherein said two adjacent rungs are a lowermost two rungs of said ladder and wherein said first rung is an upper one of said two adjacent rungs and said second rung is a lowermost rung of said two adjacent rungs.

14. A safety ladder incorporating a warning circuit indicating when a user approaches a top or a bottom of said safety ladder, said safety ladder comprising:

a ladder having two stiles laterally spaced one from the other and a plurality of rungs substantially regularly spaced therealong, said rungs affixed to and laterally extending between said stiles;

an upper electronic warning circuit incorporated with two adjacent rungs proximate to a top of said ladder and sensing a user ascending said ladder, said upper electronic warning circuit issuing an audible warning in response thereto, said upper electronic warning circuit comprising:

a first sensor affixed to a lower one of said two upper adjacent rungs and responsive to the placement of a first of a user's feet on said first sensor by changing said first sensor from a non-conducting state to a conducting state, for an entire time the first of the user's feet is placed on the first sensor;

a second sensor affixed to an upper one of said two upper adjacent rungs and responsive to the placement of a second of the user's feet on said second sensor by changing said second sensor from a non-conducting state to a conducting state beginning from the time of initial placement of the second of the user's feet on said second sensor, for a predetermined period of time, and returning to the non-conducting state after the predetermined period of time has elapsed, said predetermined period of time being less than the time the user takes to move his feet from one rung to the next rung, said second sensor being electrically connected in series to said first sensor;

a first single shot latching relay having a start terminal electrically connected to said second sensor, said first single shot latching relay also having a power input terminal, a common terminal, and a load output terminal;

a first power source having a power output terminal electrically connected to said first sensor and said power input terminal of said first single shot latching relay, said first power source also having a common terminal; and a first sound device electrically connected to said load output terminal of said first single shot latching relay and to said common terminal of said first power source to complete said upper electronic warning circuit;

wherein said load output terminal of said first single shot latching relay, and thereby said first sound device, are energized when both said first and second sensors are in conducting states at the same time in response to placement of the first and second feet of the user on said first and second sensors as the user ascends; and a lower electronic warning circuit incorporated with two adjacent lowermost rungs of said ladder and sensing the user descending said ladder, said lower electronic warning circuit issuing an audible warning in response thereto, said lower electronic warning circuit comprising:

a third sensor affixed to an upper one of said two lowermost adjacent rungs and responsive to the placement of a first of a user's feet on said third sensor by changing said third sensor from a non-conducting state to a conducting state, for an entire time the first of the user's feet is placed on the third sensor;

a fourth sensor affixed to a lower one of said two lowermost adjacent rungs and responsive to the placement of a second of the user's feet on said fourth sensor by changing said fourth sensor from a non-conducting state to a conducting state beginning from the time of initial placement of the second of the user's feet on said second sensor, for a predetermined period of time, and returning to the non-conducting state after the predetermined period of time has elapsed, said predetermined period of time being less than the time the user takes to move his feet from one rung to the next rung, said fourth sensor being electrically connected in series to said third sensor;

a second single shot latching relay having a start terminal electrically connected to said fourth sensor, said second single shot latching relay also having a power input terminal, a common terminal, and a load output terminal;

a second power source having a power output terminal electrically connected to said third sensor and said power input terminal of said second single shot latching relay, said second power source also having a common terminal; and a second sound device electrically connected to said load output terminal of said second single shot latching relay and to said common terminal of said second power source to complete said lower electronic warning circuit;

wherein said load output terminal of said second single shot latching relay, and thereby said second sound device, are energized when both said third and fourth sensors are in conducting states at the same time in response to placement of the first and second feet of the user on said third and fourth sensors as the user descends.

15. The safety ladder according to claim 14 wherein said first, second, third and fourth sensors are switches.

16. The safety ladder according to claim 14 wherein said first and second power sources of said upper electronic warning circuit and said lower electronic warning circuit are a single battery.

* * * * *